US005539284A

United States Patent [19]

Stone

[11] Patent Number: 5,539,284

[45] Date of Patent: Jul. 23, 1996

[54] FLUORESCENT LAMP BALLAST DIMMING CONTROL CICUIT

[75] Inventor: Everett S. Stone, Santa Rosa, Calif.

[73] Assignee: Hybrinetics, Inc., Santa Rosa, Calif.

[21] Appl. No.: 328,261

[22] Filed: Sep. 29, 1994

[51] Int. Cl.[6] ..... H05B 37/02

[52] U.S. Cl. ..... 315/360; 315/DIG. 4; 315/307

[58] Field of Search ..... 315/291, 307, 315/308, DIG. 4, 360

[56] References Cited

U.S. PATENT DOCUMENTS 4,950,963 8/1990 Sievers ..... 315/360

OTHER PUBLICATIONS

*Philips Guide to Fluorescent Lamps.*
*Advanced Ballasts* Data Sheet.
*Sylvania GTE Engineering Bulletin* 0–341.

*Primary Examiner*—Frank González
*Assistant Examiner*—Reginald A. Ratliff
*Attorney, Agent, or Firm*—Flehr, Hohbach, Test, Albritton & Herbert

[57] ABSTRACT

A dimming control circuit for connection to a nondimming ballast in a fluorescent lighting system is disclosed herein. The control circuit is switchably connected to a source of AC voltage within the lighting system, while the ballast includes terminals for connecting to a fluorescent lamp. A power control module within the control circuit is operative to conduct a controllable portion of the voltage waveform provided by the source of AC voltage to the ballast in accordance with a brightness control signal received by a phase control circuit. A turn-on module, operatively coupled to the power control module, operates to shunt current from the phase control circuit during a turn-on interval commencing upon connection of the dimming control circuit to the source of AC voltage in order that substantially the entire voltage waveform is provided to the ballast during the turn-on interval.

15 Claims, 9 Drawing Sheets

FLUORESCENT LAMP BALLAST DIMMING CONTROL CICUIT

The present invention relates generally to dimming systems for fluorescent lamps, and more particularly to a circuit which allows dimming of fluorescent lamps driven by conventional non-dimming ballasts.

BACKGROUND OF THE INVENTION

Continuous dimming of lighting can be desirable for reasons of both energy efficiency and consumer preference. Dimming can change the atmosphere of the illuminated area, or, more practically, can adjust the electrical lighting in a space to compensate for variations in natural lighting.

The dimming of fluorescent lamps presents difficulties relating to the large voltage required to turn on the lamp through the initiation of an electrical arc in the tube. In particular, upon initial application of a normal operating voltage across the electrodes of a gas discharge lamp, insufficient numbers of free electrons exist in order to begin the cumulative ionization which carries the lamp current and maintains the discharge. Therefore, the electrodes must first be heated to thermionic emission temperature in order to produce the required free electrons. After conduction through the lamp has begun, it is not necessary for thermionic emission to continue.

Various methods have been employed to start gas discharge lamps, and, in particular, fluorescent lamps. One method involves the use of a starter switch operative to conduct the initially applied electrical current across the electrodes at either end of a fluorescent lamp. Once the electrodes have been electrically heated to thermionic emission temperature, the switch is opened, and the lamp is started. Alternatively, "starterless" circuits have been devised in which an AC current is applied to a standard ballast coupled to the lamp. A portion of the ballast output current is then used to heat the lamp electrodes to thermionic emission temperature.

Dimming devices for fluorescent lamps generally rely upon solid state components such as triacs to block portions of each half-cycle of the incoming voltage. By only allowing portions of each half-cycle to be conducted to the lamp, the amount of power delivered is thereby reduced. A problem with such dimming devices, when applied to gas discharge lamps, is that full power is needed to start the lamp because of the thermionic emission requirement discussed above. This means that a user must first apply full power to the lamp and then manually adjust the dimming device to the desired level. The dimming device cannot, therefore, be left at the desired setting since it must be readjusted every time the lamp is turned on. Also, when power outages occur, the lamps will not start automatically when power is returned if the dimming device is operative, again requiring manual intervention.

As noted above, dimming of incandescent lamps has been effected using phase control dimmers where energy to the load is controlled by varying the firing angle or "on" time of each half cycle of the A.C. supply power. However, while such dimmers when used in conjunction with standard fluorescent lamps coupled to standard lamp ballasts can satisfactorily control the energy to the high voltage portion of the lamps, at large firing angles the power supplied to lamp filaments may be insufficient to sustain illumination. Accordingly, full-range dimming of fluorescent lamps using phase control has been difficult to accomplish as a result of the minimum voltage required to adequately charge gases within such lamps.

It can thus be appreciated that it would be advantageous to have a method and apparatus for dimming fluorescent lamps over a full range of brightness. In addition, currently available fluorescent lamp dimmers require special ballasts for the lamp so that the filament is supplied its required power while either the voltage, current, or both supplied to the discharge potion of the lamp is varied to control brightness. A significant limitation of dimming systems using special ballasts is that the standard ballasts must be replaced with the special ballasts in order to dim the lamps involved. Hence, in order to avoid the expense involved in this replacement process it would be advantageous to provide a technique for modification of standard non-dimming ballasts to a configuration allowing for dimming of fluorescent lamps.

It would be additionally advantageous to provide a fluorescent lamp dimmer capable of being directly substituted for the two-wire on/off switch conventionally used in conjunction with fluorescent lamps. That is, dimming control circuits not requiring connection to a third "neutral wire" or the like could be straightforwardly substituted for existing two-wire lamp switches.

A dimming device which addresses the problem of starting gas discharge lamps is described in U.S. Pat. No. 4,950,963. The '963 device includes a circuit comprised of a diac, a triac and a timing capacitor for conducting an adjustable portion of an AC supply voltage to a lamp. In addition, the '963 device operates to conduct the entire AC waveform to the lamp for a preselected time upon initial application of power to the apparatus.

The device described above, however, is believed to be disadvantaged in at least several respects. For example, in order to convert the AC line voltage to a DC voltage for use by a timer circuit within the '963 device, a bridge rectifier is employed in combination with a resistive network. This resistive network dissipates heat, which could require mounting the device upon a heat sink or the like. In operation, the voltage impressed on a charging capacitor connected across a bridge circuit determines the voltage applied to the input of the diac. Unfortunately, the '963 device makes no provision for filming spurious electrical noise generated as a consequence of the delayed firing of the triae as determined by the time constant of the dimming control circuit. In addition, the '963 device requires connection to an AC neutral line of the fluorescent lamp fixture for which it is providing dimming control.

OBJECTS OF THE INVENTION

It is therefore an object of the invention to provide a dimming control circuit, connectable to conventional non-dimmable fluorescent lamp ballasts, which enables an adjustable degree of dimming while allowing the lamp to be started without disturbing the dimming adjustment.

It is a further object to provide a dimming apparatus which applies a preselected level of power to the lamp or lamps upon initial starting with no dependence upon the dimming adjustment.

It is yet another object of the invention that such a dimming circuit allow for dimming over a full range of brightness.

Yet a further object of the present invention is to provide a dimming control circuit configured to require connection to only the existing wire pair of a conventional two-wire on/off switch.

Yet a still further object of the present invention is to provide a dimmer control circuit which primarily relies upon reactive elements, rather than resistive elements, in conversion of an input AC line voltage to a DC timer voltage.

SUMMARY OF THE INVENTION

In summary, the present invention is a dimming control circuit for connection to a nondimming ballast in a fluorescent lighting system. The control circuit is switchably connected to a source of AC voltage within the lighting system, while the ballast includes terminals for connecting to a fluorescent lamp. A power control module within the control circuit is operative to conduct a controllable portion of the voltage waveform provided by the source of AC voltage to the ballast in accordance with a brightness control signal received by a phase control circuit. A turn-on module, operatively coupled to the power control module, operates to shunt current from the phase control circuit during a turn-on interval commencing upon connection of the dimming control circuit to the source of AC voltage in order that substantially the entire voltage waveform is provided to the ballast during the turn-on interval.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
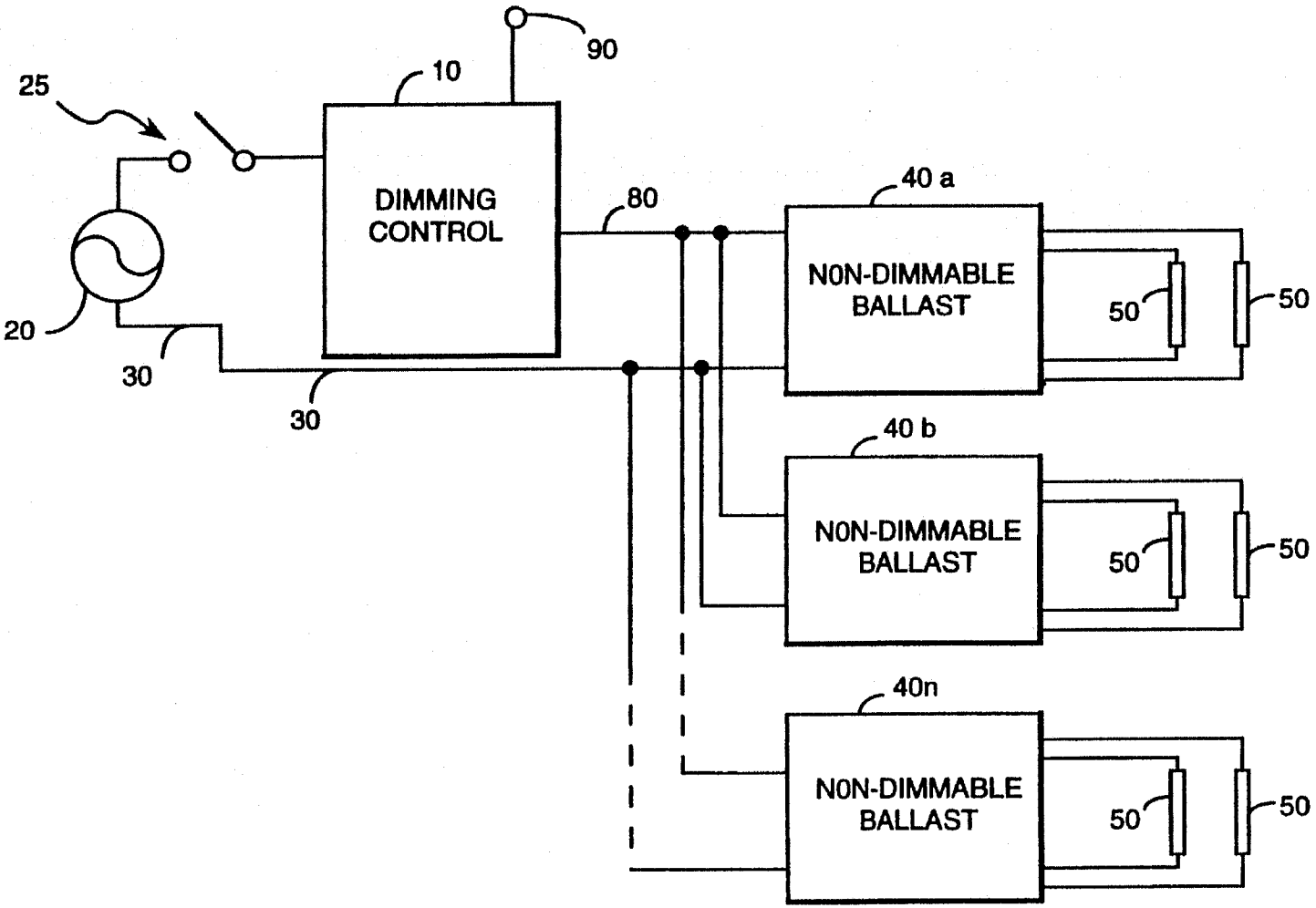
FIG. 1 shows a simplified block diagram of a dimmable fluorescent lighting system in accordance with the invention.

FIG. 1 shows a simplified block diagram of a dimmable fluorescent lighting system in accordance with the invention. A dimming control circuit 10 is connected to a standard A.C. voltage source 20 (typically a 50 or 60 Hz A.C. power line at 120 or 240 volts) through an input switch 25 and reference input 30. The control circuit 10 serves to couple the voltage source 20 to a set of up to n standard nondimmable fluorescent lamp ballasts 40 (i.e., 40*a*, 40*b*, . . . 40*n*}. In this configuration, when switch 25 is closed the control circuit 10 becomes operational and controls the power supplied to the lamp ballasts 40. The lamp ballasts 40 will preferably be implemented using one or more conventional nondimmable magnetic or electronic ballasts coupled to a set of fluorescent lamps 50. By way of example, a set of approximately ten Ideal Electronic Ballasts (Catalog No. 56-610) manufactured by the IDEAL Corp. of Canada could be satisfactorily employed to control an arrangement of twenty fluorescent lamps 50. It is understood, however, that the ballasts 40 could also be realized using a set of n conventional rapid-start or instant-start fluorescent lamp ballasts.

Figure 2:
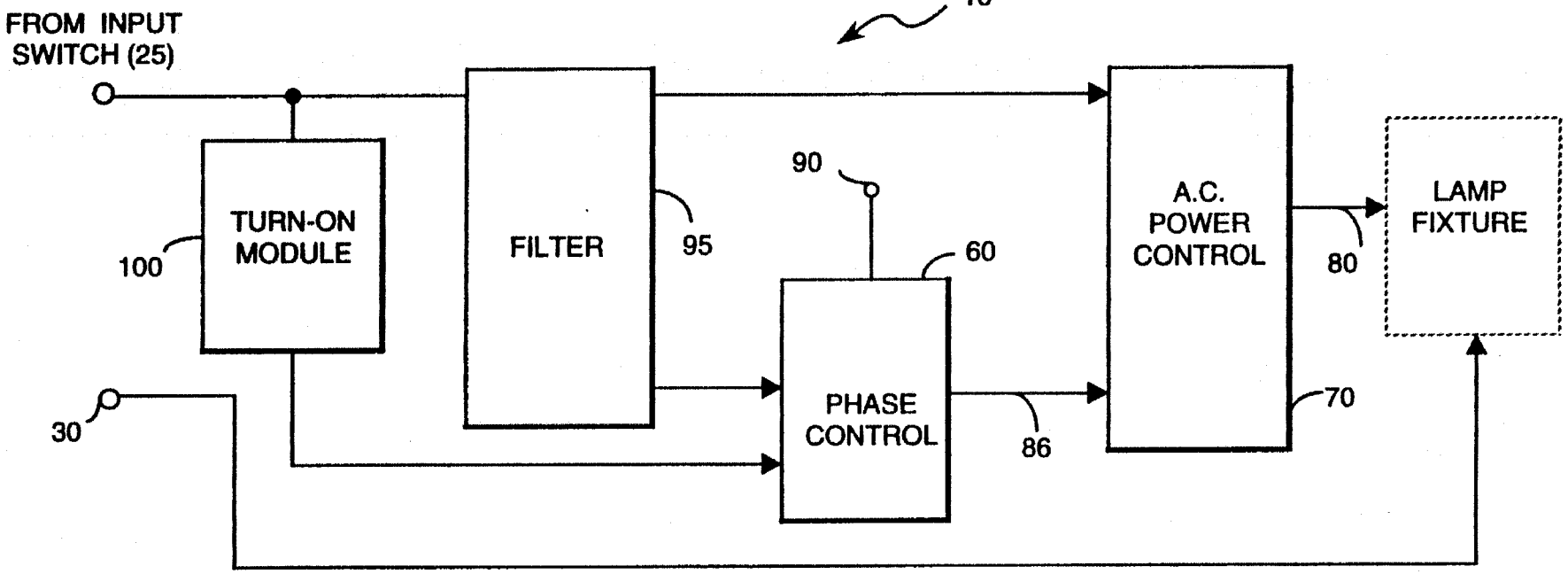
FIG. 2 is a block diagram depiction of a preferred embodiment of the power control circuit of the invention.
Figure 3:
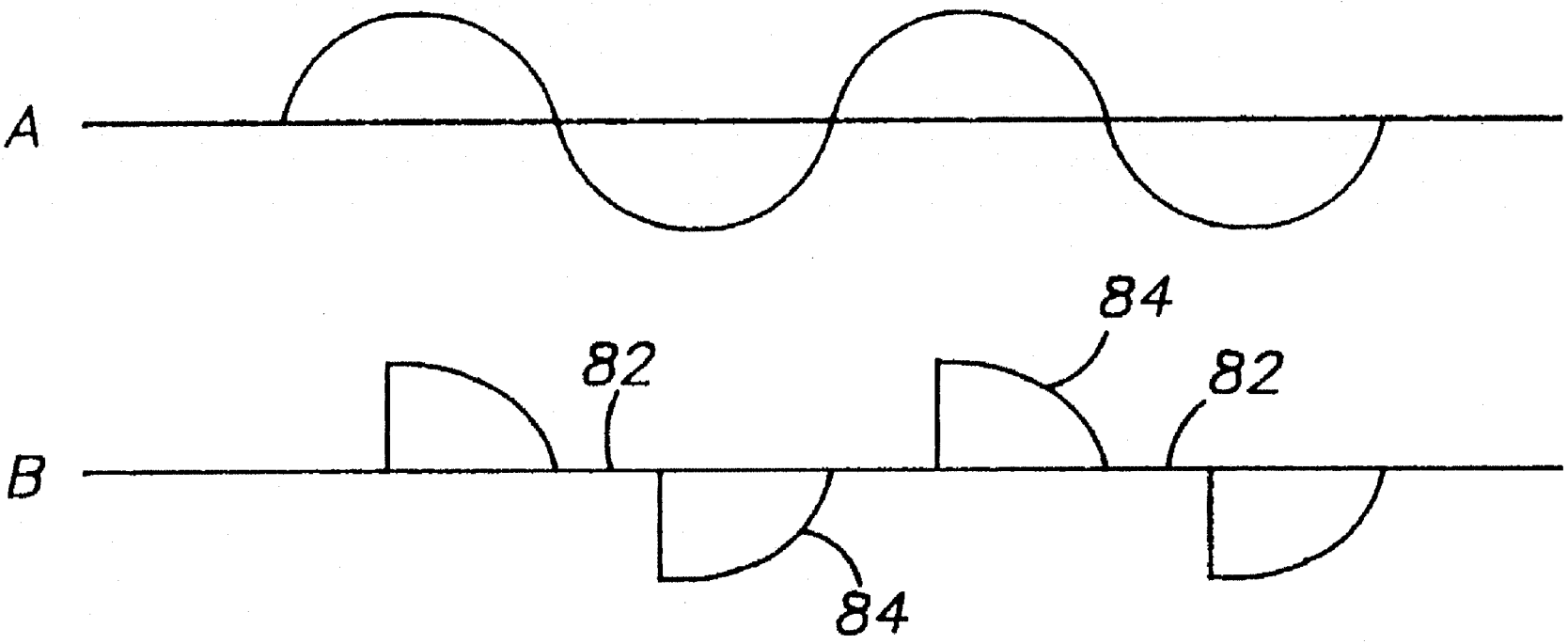
FIG. 3 provides a graphical comparison of the input sinusoidal voltage waveform with the waveform supplied to the lamp ballasts by an A.C. power control module included within the invention.

The add-on dimming control circuit 10 of the present invention operates to controllably vary the average lamp current to achieve brightness control. Referring to the block diagram of the control circuit 10 shown in FIG. 2, the main light level control of the invention is provided by an A.C. phase control module 60. This circuitry controls the phase angle of the A.C. power supplied to the lamp ballast of a given fluorescent lamp fixture. This in turn allows control to be exercised over the amount of time during each half cycle of the A.C. sine wave that line power is supplied to the ballast by power control module 70. Accordingly, as is shown in FIG. 3, while the line A.C. voltage provided by switch 25 is shown as the sinusoidal wave on axis A, the portion of that actually supplied to the ballasts 40 by A.C. power control module 70 on ballast output line 80 is a waveform shown in axis B. The waveform on axis B is seen to have an OFF time 82 where the value is zero, and an ON time 84 where the peak value of the waveform is the same as that of the line voltage. By varying the respective ON and OFF times of the wave impressed on ballast output line 80, the power delivered to the ballasts 40 is controlled. The longer the ON time, the closer the effective voltage applied to the ballast is to the line voltage.

As is described below, the A.C. phase control module 60 generates signals 86 responsible for determining the relative ON and OFF times of the line A.C. voltage in accordance with an adjustable brightness level control signal impressed on level control terminal 90. The power control module 70 will generally include, for example, a triac responsive to the signals from phase control module 60 for forming the A.C. signal actually impressed on ballast output line 80.

Referring again to FIG. 2, the control circuit 10 is seen to include a filter 95 for attenuating electrical noise produced by components within the A.C. phase control and A.C. power control networks 60 and 70. The control circuit 10 further includes a turn-on module 100 serially connected between input switch 25 and the phase control module 60. The turn-on module 100 is designed to ensure that the power delivered to the ballasts 40 upon closing of switch 25 is initially of sufficient magnitude to actuate the fluorescent lamps 50 irrespective of the value of the level control signal impressed upon the control terminal 90. That is, the turn-on module 100 operates to "override" level control signals associated with less than a predefined level of lamp brightness during a brief turn-on interval commencing upon closing of switch 25. This advantageously allows a user to specify a relatively low lamp brightness level via control terminal 90 without regard to the level of power required to initially turn-on, i.e., to "ignite", the fluorescent lamps 50.

Figure 4:
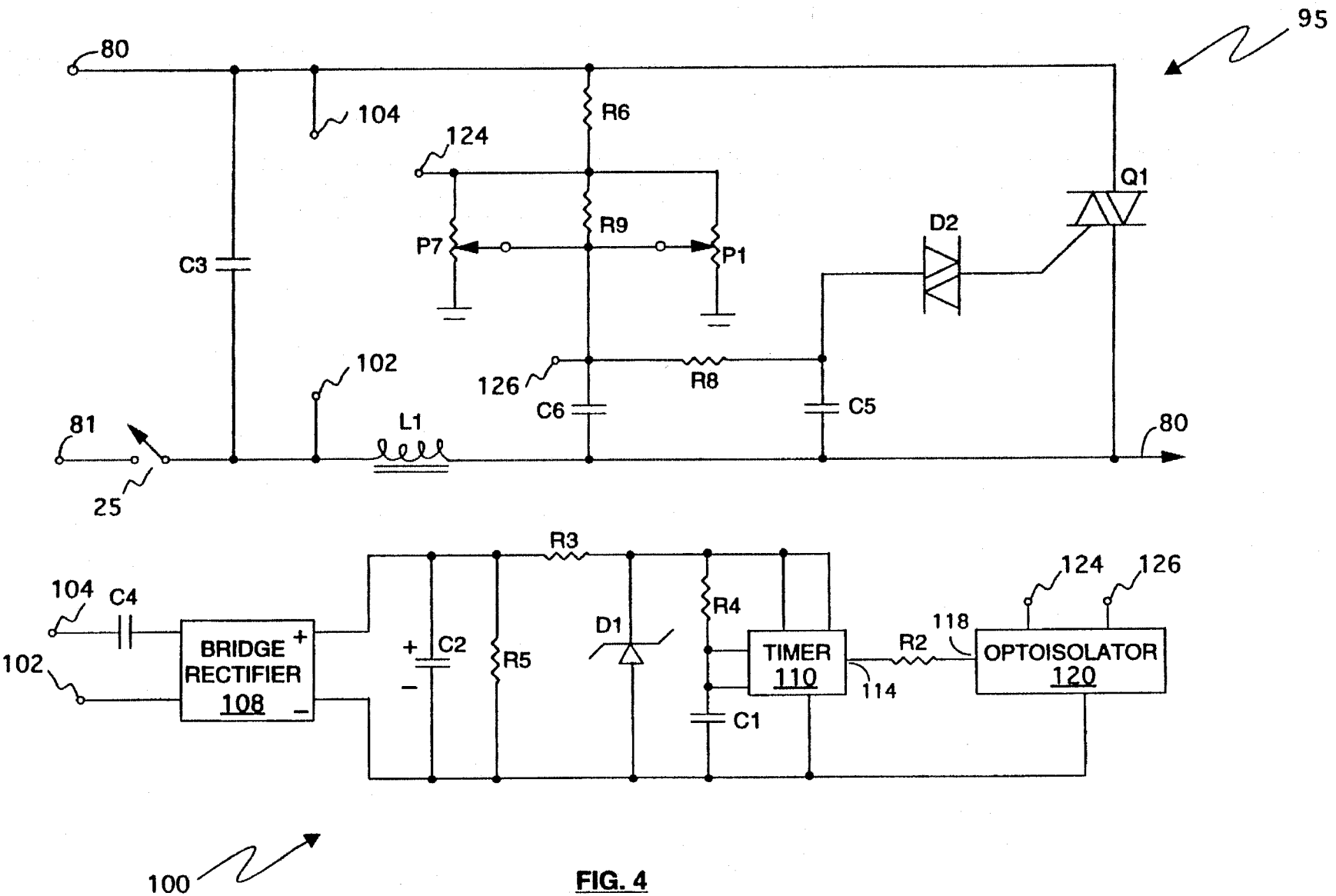
FIG. 4 is a schematic representation of a preferred embodiment of the control circuit of the invention.

FIG. 4 schematically represents an implementation of the control circuit 10 designed to be compatible with instant-start fluorescent lamp fixtures. In contrast to conventional fluorescent dimming control circuits, the control circuit 10 does not require electrical connection to an AC neutral, or "current-carrying" wire generally connected to the ballast within fluorescent lamp fixtures. This isolation between the control circuit 10 and the AC neutral wire allows replacement of existing two wire on-off switches without the requirement that the surrounding wiring also be changed. The switch 25 couples, to both the turn-on module 100 and the input filter 95 at the input terminals 102 and 104, the pair of wires 80, 81 normally connected to a conventional ON/OFF switch. The input filter 95 includes an inductor L1 in series with the switch 25, and a capacitor C3 bridging the switch 25 to the input terminal 104. The values of L1 and C3 are chosen to attenuate frequencies in excess of the frequency (60 Hz) of the voltage source. In an exemplary implementation L1 is selected to be within the range of 25–50 microhenries (μH), and C3 within the range of 0.1–0.22 microfarads (μF).

Referring to FIG. 4, the turn-on module 100 includes an input capacitor C4 connected in series between input terminal 104 and a first input of bridge rectifier 108. The other input to the bridge rectifier 108 is connected to switch 25 at input terminal 102. The DC output of the bridge rectifier 108 is filtered by capacitor C2 and resistor R5, and is regulated to approximately 15 V by resistor R3 and zener diode D1. Exemplary component values are as follows: C4=0.22 μF, C2=100 μF, R5=10 kΩ, R3=330 Ω. In addition, D1 may be realized using an IN4744 zener diode, and the bridge rectifier 108 realized using a VM68 bridge rectifier. The 15 V output is used as the supply voltage for a timer 110 such as, for example, an LM 555 timer manufactured by the National Semiconductor Corp. of Santa Clara, Calif. Upon closing of the switch 25, terminal 114 of the timer 110 immediately assumes a DC voltage level of between 7–12 volts and capacitor C1 begins to charge through resistor R4 to the same level of voltage. After expiration of a turn-on interval, which has a duration determined by the RC time constant of C1 and R4, the voltage level at timer output terminal 114 drops to zero. In an exemplary embodiment an RC time constant of between 2 and 3 seconds is achieved selecting the value of C1 to be approximately 10 μF and the value of R4 to be approximately 240 kΩ.

As is indicated by FIG. 4, the output voltage at terminal 114 is used to drive input terminal 118 of optoisolator 120. The optoisolator 120 may be realized by using, for example, a Motorola MOC 3021. During the turn-on interval the voltage at input terminal 118 remains high, and the output terminals of the optoisolator 120 provide an effective short-circuit across terminals 124 and 126 of a potentiometer circuit within the phase control module 60. The potentiometer circuit is seen to include brightness control potentiometers P1 and P7 connected between the terminals 124 and 126, where the connection of potentiometers P1 and P7 to brightness control terminal 90 has been omitted for clarity. During the turn-on interval the optoisolator 120 forms a bypass connection across terminals 124 and 126, thereby briefly shunting all current from potentiometers P1 and P7. The creation of this momentary short-circuit between the terminals 124 and 126 corresponds to a full brightness setting of potentiometers P1 and P7. The formation of this bypass connection advantageously enables application of the requisite voltage to the input of diac D2 during the turn-on interval without utilization of, for example, a bridge rectifier circuit of the type depicted in the above-referenced '963 patent.

Referring again to FIG. 4, in an exemplary embodiment phase control module 60 is realized using potentiometers P1 and P7, resistors R6, R8, and R9, and capacitors C5 and C6. Resistor R6 serves to prevent excessive current from flowing through potentiometers P1 and P7 when these are set at minimum resistance. Potentiometer P7 may be described as the principal brightness control potentiometer, with P1 allowing adjustment to be made to the minimum brightness level when P7 is set to its minimum setting. Resistor R9 smooths changes in brightness by lessening circuit sensitivity to minor potentiometer adjustments.

The time constant of the phase control module 60 is determined by the values and settings of P1, R6, P7, RS, R9, C5 and C6. Larger phase control time constants lengthen the "off" periods during which the AC line signal is prevented from being applied to the lamp ballast, and shorten the "on" periods within which the AC signal is applied the lamp ballast. That is, the phase control circuit time constant can be set to adjust the conduction period of the AC line signal (see, e.g., FIG. 3) through the power control circuit 70.

In order to minimize hysteresis effects, a double time constant hysteresis reduction circuit consisting of C5, C6, and R8 is employed to ensure that the turn-on and turn-off settings of the potentiometers P1 and P7 are approximately equivalent. In operation, capacitor C6 provides additional electrical charge to capacitor C5 during each period following the firing of diac D2. The In an exemplary embodiment, components having the following values are used to realized the phase control module 60:R6 =4.7 kΩ, R9=200 kΩ, C5=C6=0.1 μF, and resistors of 500 kΩ and 110 kΩ are used in potentiometers P1 and P7, respectively.

Referring again to FIG. 4, the AC power control module 70 includes a diac D2 and triae Q1. These elements may be respectively realized using, for example, an HT32 diac and an L4008L6 or Q4015L5 triac, each available from Teccor Electronics of Irving, Tex. Upon the instantaneous voltage across C5 exceeding the actuation voltage of diae D2 (e.g., ≈32 volts), current is conducted by the diac D2 to the triac Q1. This causes conduction through the triac Q1, thus establishing coupling of the AC voltage to the lamp ballast(s) 40 by dosing the circuit between terminals 102 and 104. Again, the point in each AC half-cycle at which such conduction occurs is dependent upon the settings of potentiometers P1 and P7.

Figure 5:
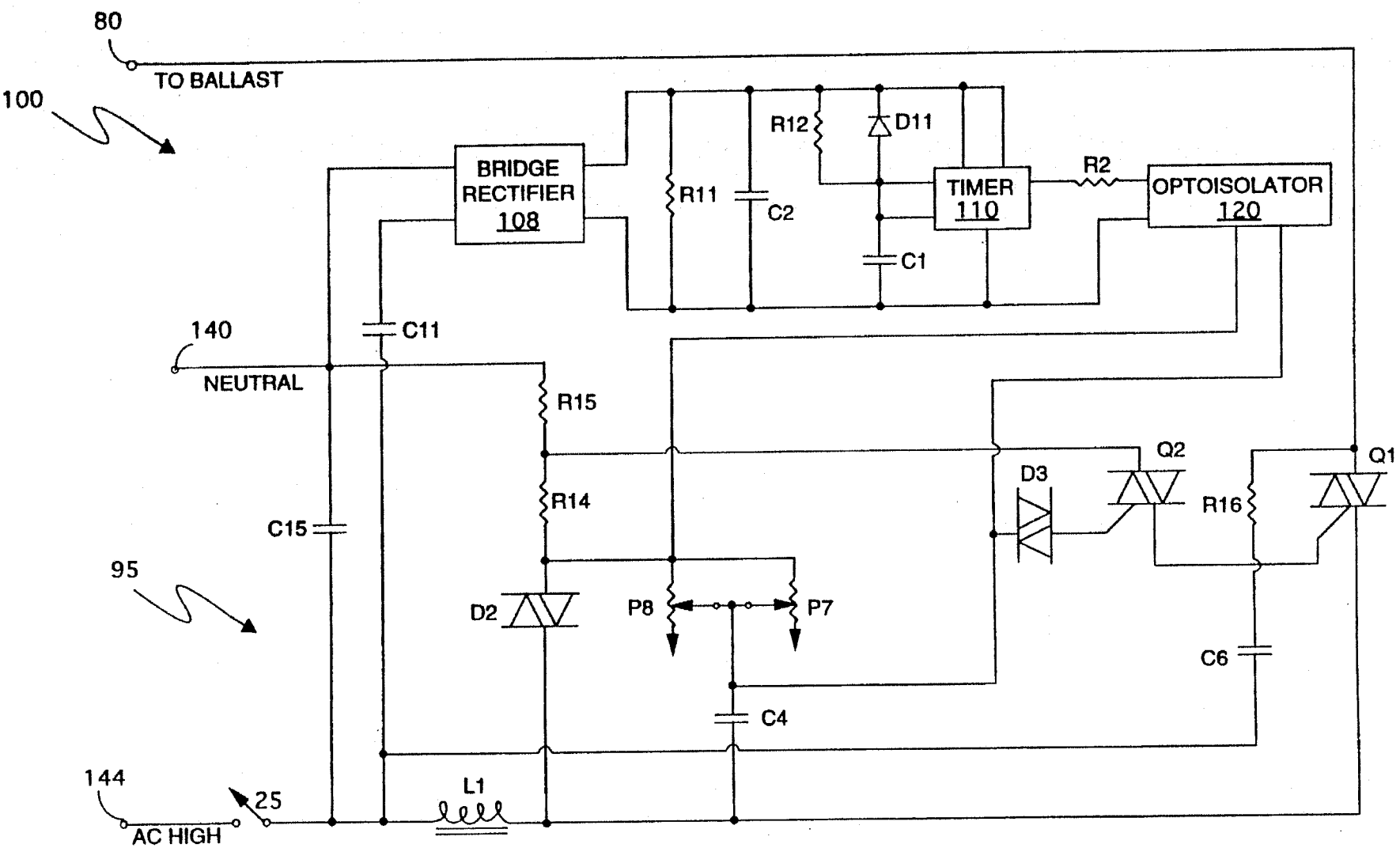
FIG. 5 schematically represents an alternately preferred embodiment of the dimming control circuit capable of versatile control of instant-start fluorescent lamps having electronic or magnetic ballasts.

FIG. 5 schematically represents an alternately preferred embodiment of the dimming control circuit capable of versatile control of instant-start fluorescent lamps having either electronic or magnetic ballasts. Since a number of like circuit elements exist in FIGS. 4 and 5, like identifiers and reference numerals will be employed in FIGS. 4 and 5 where appropriate. The control circuit of FIG. 5 provides an additional terminal connection, in the form of a neutral wire 140, in order to enable versatile control over both electronic and magnetic non-dimmable ballasts. In the embodiment of FIG. 5 it is assumed that a gas discharge lamp, in which is included some type of lamp ballast, is connected across lines 80 and 140.

FIGS. 4 and 5 depict substantially similar implementations of the turn-on module 100, with the exception that in FIG. 5 a slightly different arrangement of resistors R11, R12 and diode D11 is used in lieu of resistors R3–R5 and diode D1 (FIG. 4). In FIG. 5, the input filter 95 includes capacitor C15 and inductor L1, which operate in a manner similar to that described above with reference to the input filter of FIG. 4. Also with reference to FIG. 5, phase control module 60 is seen to include capacitor C4, resistors R14, R15 and potentiometers P7 and P8, and diac D2. Resistors R14 and R15, in combination with diac D2, provide a relatively constant voltage to the potentiometers P7 and P8. The following component values were used in an exemplary realization of the circuit of FIG. 5: R14=6.8 kΩ, R5=51 kΩ, P7 and P8 each include 500 kΩ resistors, and C4=0.047 μF.

The time constant of the phase control circuit is determined by the value of capacitor C4, and by the settings of potentiometers P7 and P8 via brighiness control terminal 90. The AC power control module 70 is implemented differently in FIG. 5 than in FIG. 4, in that it includes a diac D3 and a pair of triacs Q1 and Q2. In a specific realization an HT32 diac was used for diac D3, and triacs Q1 and Q2 were implemented using L4008L6 and L201E5 triacs, each of which are manufactured by Teccor Electronics of Irving, Tex. In operation, an increase in the instantaneous voltage across capacitor C4 beyond the firing voltage of diac D3 (≈32 V) causes diac D3 to supply gate current to the triac Q2. The resulting conduction of current through triac Q2 in turn provides gate current to triac Q1. In response, current is conducted by triac Q1, thereby connecting the input AC high line 144 to the input line 80 of the ballasts 40. Resistor R16 and capacitor C6 serve as a snubber network designed to prevent spurious firing of triac Q1. In an exemplary realization R6 is selected to be approximately 27 Ω, and C6 chosen to be approximately 0.22 μF. During operation following expiration of the turn-on interval, the settings of potentiometers P7 and P8 determine the percentage of each AC half-cycle that AC power is supplied to the lamp ballast through triac Q1.

Figure 6:
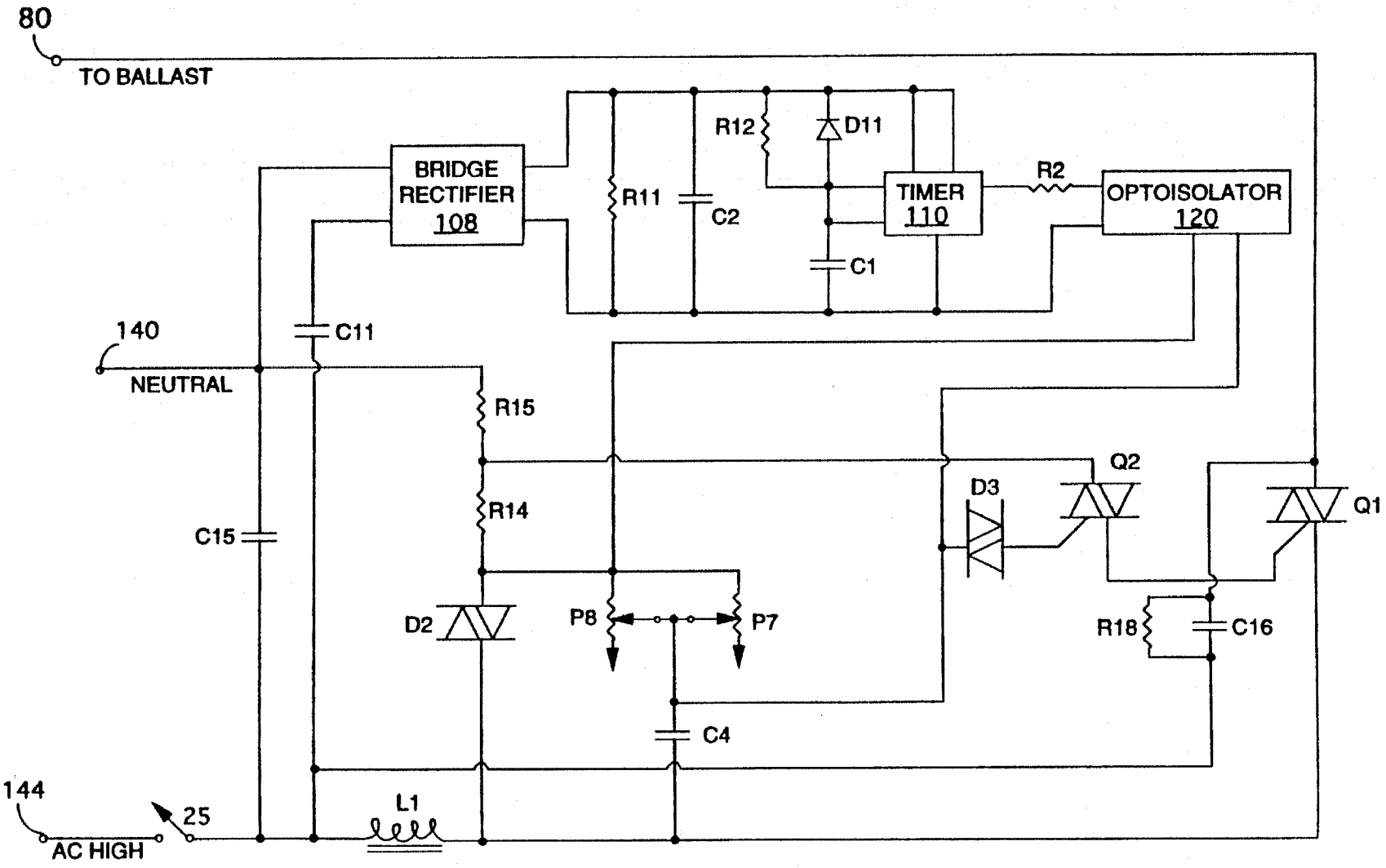
FIG. 6 schematically represents an embodiment of the dimming control circuit designed to be of particular utility when used with rapid-start fluorescent lamps.

FIG. 6 schematically represents an embodiment of the dimming control circuit designed to be of particular utility when used with rapid-start fluorescent lamps. The control circuit of FIG. 6 may advantageously be enclosed within a single-gang electrical box, and in an exemplary implementation is capable of controlling a set of four 40 W rapid-start fluorescent lamps. Given the substantial similarity between FIGS. 5 and 6, like reference numerals have been employed to identify like circuit elements. A triac bypass circuit comprised of resistor R18 and capacitor C16 is designed to reduce the tendency of fluorescent lamps, and particularly rapid-start fluorescent lamps, to "flicker" when the potentiometer circuit is set to relatively low levels of brightness. In an exemplary implementation of the bypass circuit the resistor R18 is selected to be approximately 27 kΩ, and capacitor C16 is chosen to be approximately 3.3 μF.

Figure 7:
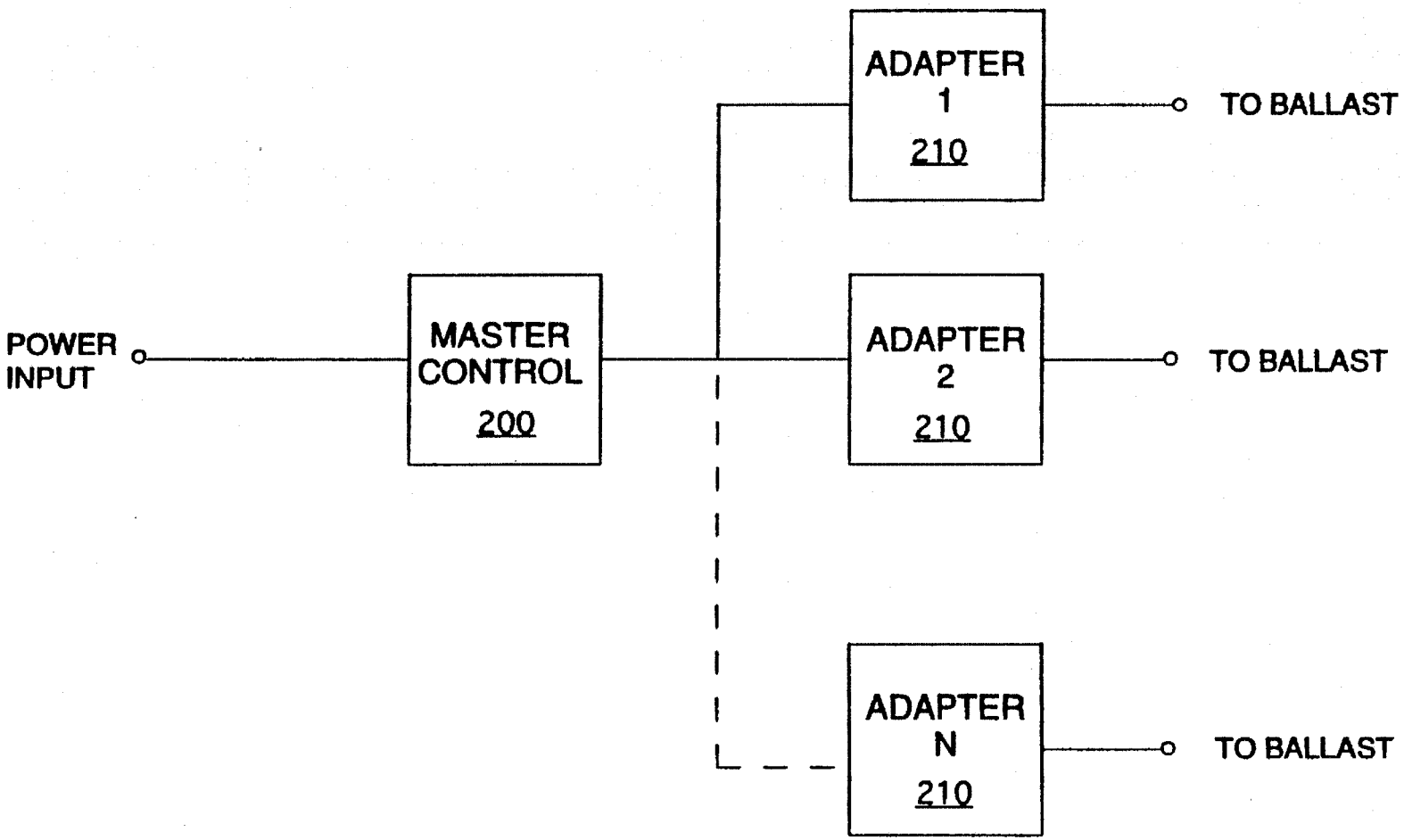
FIG. 7 shows a block diagram of a master dimmer control unit and a set of N adapter units which collectively operate to enable dimming control of a corresponding set of N fluorescent lamp ballasts.

Referring now to FIG. 7, there is shown a block diagram of a master dimmer control unit 200 and a set of N adapter units 210 which collectively operate to enable dimming control of a corresponding set of N gas discharge lamps (not shown). In a particular embodiment, the adapter units 210 are configured to provide an interface between the control unit 210 and one or more ballasts for rapid-start fluorescent lamps.

Figure 8:
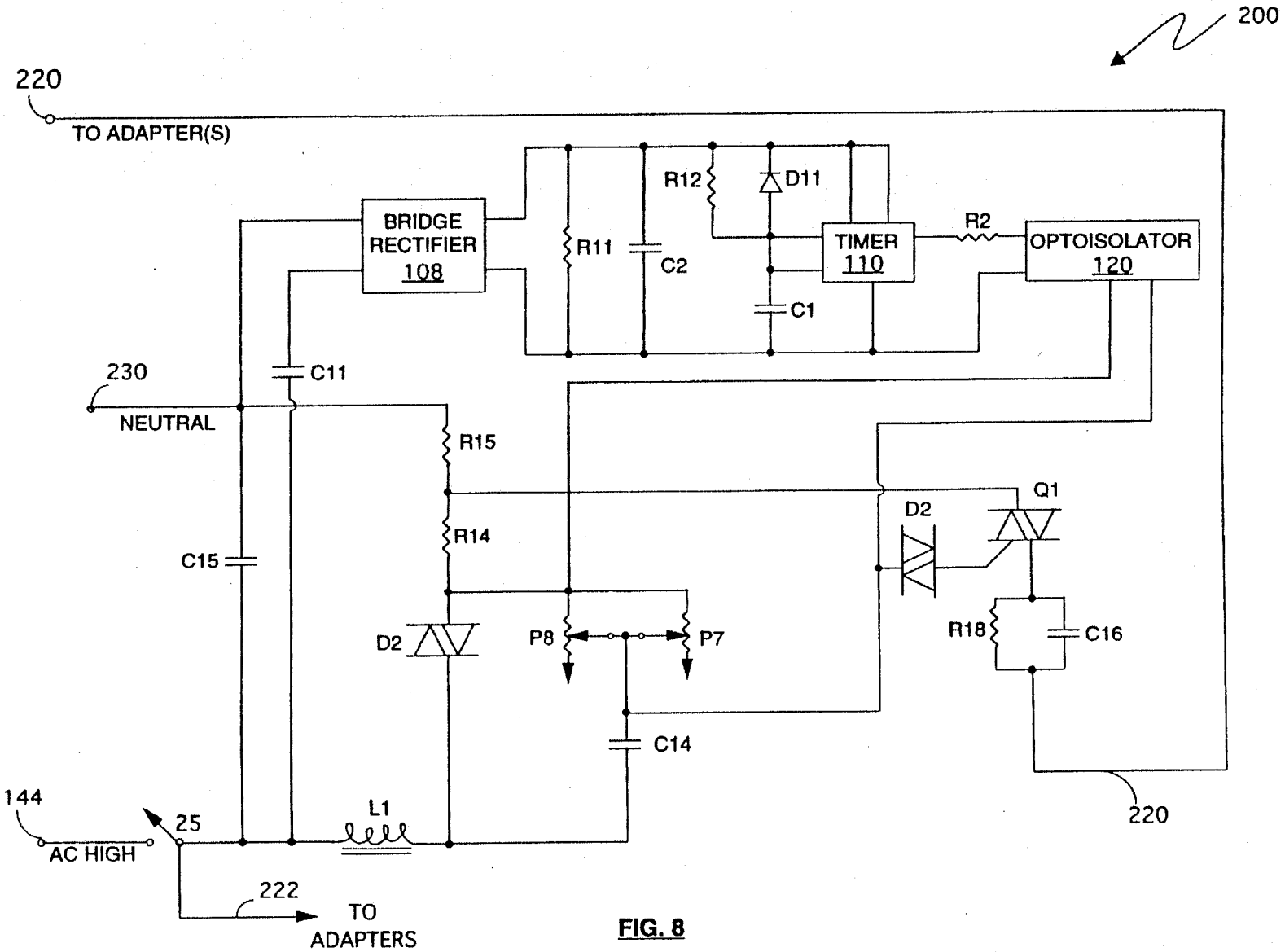
FIG. 8 provides a schematic representation of an exemplary implementation of the master dimmer control unit of FIG. 7.
Figure 9:
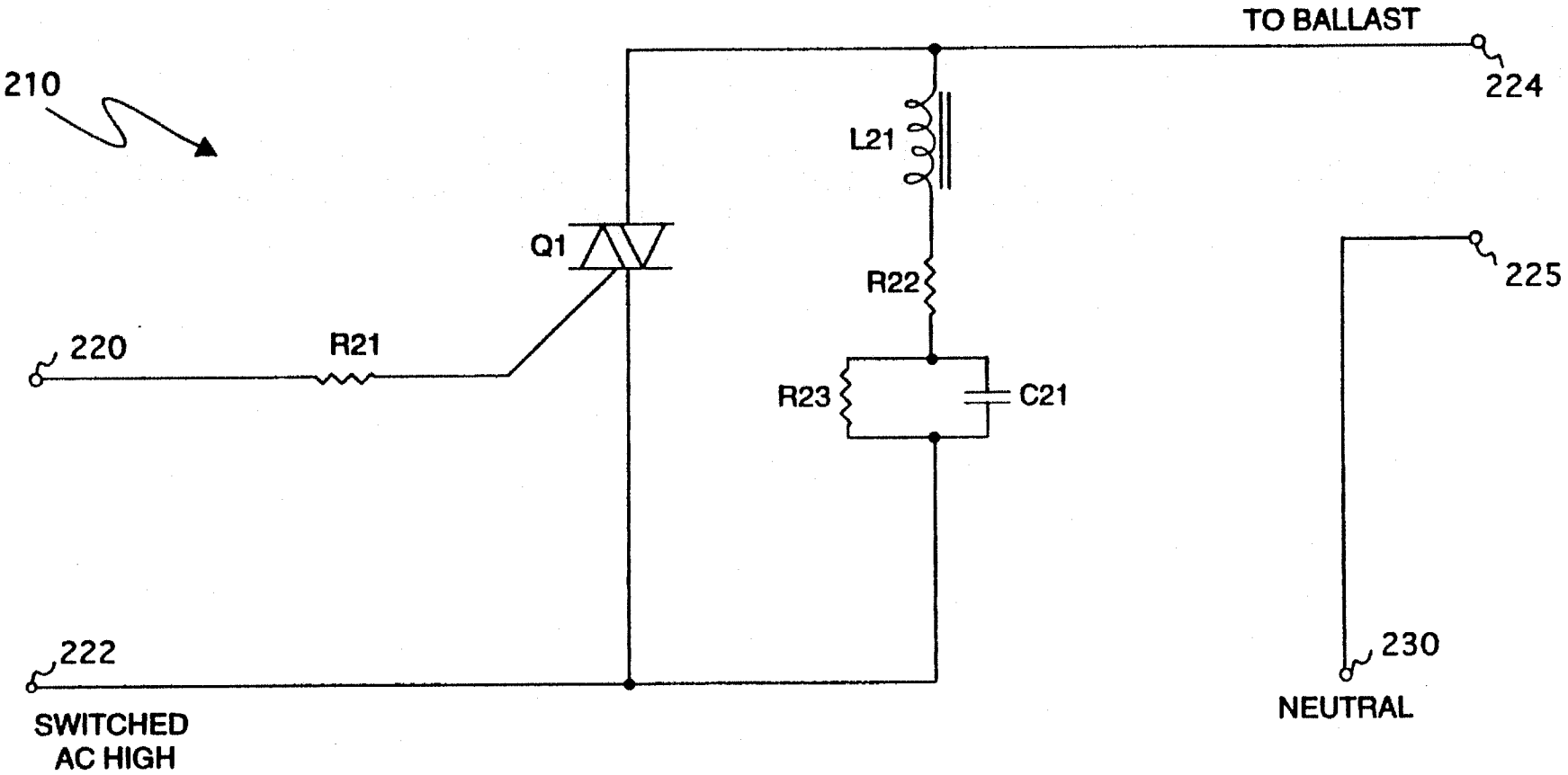
FIG. 9 schematically depicts a preferred embodiment of one of the adapter modules of FIG. 7.

FIG. 8 provides a schematic representation of an exemplary implementation of the control circuit of the master dimmer control unit 200. In the embodiment of FIG. 8, like reference numerals are used in identification of those circuit elements performing corresponding functions in FIGS. 6 and 8. The master dimmer control unit 200 is similar to the implementation of FIG. 6, with the exceptions that:

(i) the triac Q1 of FIG. 6 is not present within FIG. 8, and (ii) resistor R18 and capacitor C16 are arranged differently in FIG. 8 than in FIG. 6, and will generally be assigned values different from those used in the embodiment of FIG. 6. As is indicated by FIG. 8, resistor R18 and capacitor C16 form a coupling network connected to an output terminal of triac Q1. This coupling network serves to couple the output of triac Q1 to a dimmer control line 220, which in turn is connected to the gate of a triac disposed within each of the adapter networks 210 (FIG. 9). The triac Q1 thus functions as a "driver" for the triac within each adapter network 210. In an exemplary network the coupling network is realized using the component values of R18=1 kΩ and C16=2.2 μF.

Turning now to FIG. 9, there is provided a schematic representation of a preferred embodiment of the adapter module 210. The adapter module 210 receives the switched AC power high line 222 and the dimmer control line 220 from the master control unit 200 (FIG. 8). In operation, the adapter module 210 is disposed to drive an input line 224 connected to a first of two inputs to a fluorescent lamp ballast. In a preferred implementation the other input 225 to the fluorescent lamp ballast is connected to the neutral line within the fluorescent lamp fixture.

Referring to FIG. 9, the resistor R21 (e.g., 200 Ω) within a given adapter 210 serves to decouple the adapter from the other adapters driven by the dimmer control line 220. Resistor R21 is coupled to the gate of power a triac Q21, which is seen to be in parallel with a triac bypass circuit. The triac bypass circuit comprises an inductor L21, resistors R22 and R23, and a capacitor C21, and functions to minimize "flicker" and other spurious lamp emissions tending to occur at low intensity settings. In a particular realization the inductor L21 is selected to be within the range of 25–50 μH, resistors R22 and R23 are selected to be 47 Ω and 27 kΩ, respectively, and a capacitor C21 of approximately 9 μF is employed.

While the present invention has been described with reference to a few specific embodiments, the description is illustrative of the invention and is not to be construed as limiting the invention. Various modifications to the embodiments disclosed herein may occur to those skilled in the art without departing from the true spirit and scope of the invention as defined by the appended claims.

What is claimed is:

1. A dimming control circuit for connection to a nondimming ballast in a fluorescent lighting system including a source of AC voltage switchably connected to said control circuit, said ballast having terminals for connecting to a fluorescent lamp, said control circuit comprising:

power control means for conducting a controllable portion of the voltage waveform provided by said source of AC voltage to said ballast in accordance with a brightness control signal received by a phase control circuit, said phase control circuit producing a dimming control signal in response to said brightness control signal; and a turn-on module, operatively coupled to said power control means, for shunting current from said phase control circuit during a turn-on interval commencing upon connection of said dimming control circuit to said source of AC voltage in order that substantially said entire voltage waveform is provided to said ballast during said turn-on interval.

2. The dimming control circuit of claim 1 wherein said phase control circuit generates at least a first AC power control signal in accordance with said brightness control signal, and wherein said power control means includes a power semiconductor device having a gate terminal connected to said phase control circuit, said power semiconductor device being operative to produce output power in accordance with phase difference between said first AC power control signal and said source of AC voltage.

3. The dimming control circuit of claim 2 wherein said power semiconductor device has an input terminal switchably connected to said source of AC voltage and an output terminal connected to a control input of said nondimmable ballast.

4. The dimming control circuit of claim 3 wherein said phase control circuit includes a driver semiconductor device having a control terminal and an output terminal connected to said gate terminal of said power semiconductor device, said phase control circuit including an input potentiometer circuit for providing said dimming control signal to said control terminal on the basis of said brightness control signal.

5. The dimming control circuit of claim 1 wherein said phase control circuit includes a potentiometer circuit to which is applied a brightness control signal, and wherein said turn-on module includes:

an optoisolator circuit connected across a potentiometer circuit within said phase control circuit, said optoisolator circuit shunting said current from said potentiometer circuit during said turn-on interval;

means for providing an enabling signal to said optoisolator circuit for the duration of said turn-on interval.

6. The dimming control circuit of claim 5 wherein said means for providing an enabling signal to said optoisolator circuit includes a timer circuit which is actuated upon said connection of said dimming control circuit to said source of AC voltage.

7. The dimming control circuit of claim 6 wherein said phase control circuit includes a diac, said diac having:

an output terminal connected to a gate terminal of said power semiconductor device, and an input terminal resistively coupled to said potentiometer circuit.

8. The dimming control circuit of claim 2 further including noise filter means, operatively coupled to said phase control circuit, for attenuating electrical noise produced by said power semiconductor device.

9. The dimming control circuit of claim 4 wherein said phase control circuit further includes:

a potentiometer circuit, and a hysteresis reduction circuit for causing turn-on and turn-off of said potentiometer circuit to occur at an equivalent setting of said potentiometer circuit.

10. A dimming control circuit for use with a gas discharge lamp, said control circuit comprising:

power control means for conducting a controllable portion of the voltage waveform provided by a source of AC voltage to said lamp in accordance with a brightness control signal, said power control means including a phase control circuit to which is applied said brightness control signal; and a turn-on module for inducing said power control means to provide a predefined portion of said voltage waveform to said lamp during a turn-on interval commencing upon connection of said dimming control circuit to said source of AC voltage, said turn-on module including an optoisolator circuit for creating a bypass connection across said phase control circuit during said turn-on interval;

wherein said predefined portion of said voltage waveform is selected to be sufficient to turn on said lamp.

11. A dimming control circuit for connection to a nondimming ballast in a fluorescent lighting system including a source of AC voltage switchably connected to said control circuit, said ballast having terminals for connecting to a fluorescent lamp, said control circuit comprising:

a power control module for conducting a controllable portion of the voltage waveform provided by said source of AC voltage to said ballast in accordance with a brightness control signal, said power control module including a driver diac connected to a gate terminal of a first output triac, and further including a second output triac having a second terminal driven by said first output triac;

a turn-on module, operatively coupled to said power control means, for shunting current from said potentiometer circuit during a turn interval commencing upon connection of said dimming control circuit to said source of AC voltage in order that substantially said entire voltage waveform is provided to said ballast during said turn-on interval.

12. The dimming control circuit of claim 11 further including a snubber network for reducing spurious firing of said second output triac, said snubber network being coupled to an output terminal of said second output triac.

13. The dimming control circuit of claim 11 further including a flicker-reducing triac bypass circuit coupled to an output terminal of said second triac, said triac bypass circuit including a resistor connected in parallel with a capacitor.

14. A dimming control circuit for use with a plurality of gas discharge lamps, said control circuit comprising:

a master control unit for conducting a controllable portion of the voltage waveform provided by said source of AC voltage to a dimmer control line in accordance with a brightness control signal, said master control unit including:

a phase control circuit disposed to receive said brightness control signal, said phase control circuit producing a dimming control signal in response to said brightness control signal, and a turn-on module, operatively coupled to said phase control circuit, for shunting current from said phase control circuit during a turn-on interval commencing upon connection of said dimming control circuit to said source of AC voltage in order that substantially said entire voltage waveform is provided to said dimmer control line during said turn-on interval; and a plurality of adapter circuits, each of said adapter circuits being connected between said dimmer control line and one of said plurality of gas discharge lamps.

15. In a fluorescent lighting system including a source of AC voltage for providing power to a nondimming ballast via a dimming control circuit, said nondimming ballast having terminals for connection to a fluorescent lamp, a method for dimming said fluorescent lamp comprising the steps of:

conducting a controllable portion of the voltage waveform provided by said source of AC voltage to said ballast in accordance with a brightness control signal received by a potentiometer circuit within said dimming control circuit, shunting current from said potentiometer circuit during a turn-on interval commencing upon connection of said dimming control circuit to said source of AC voltage in order that substantially said entire voltage waveform is provided to said ballast during said turn-on interval.

* * * * *